US005732715A

United States Patent [19]

Jacobs et al.

[11] Patent Number: 5,732,715

[45] Date of Patent: Mar. 31, 1998

[54] MOUTHPIECE

[75] Inventors: Scott Jacobs, Lakewood, Colo.; Allison J. Jacobs, Bainbridge Island, Wash.

[73] Assignee: Safe-T-Gard Corporation, Lakewood, Colo.

[21] Appl. No.: 671,813

[22] Filed: Jun. 25, 1996

[51] Int. Cl.[6] ..... A61C 5/14

[52] U.S. Cl. ..... 128/861; 128/862

[58] Field of Search ..... 128/846, 848, 128/859–862; 2/2; 602/902

[56] References Cited

U.S. PATENT DOCUMENTS

| | | | |
|---|---|---|---|
| D. 343,928 | 2/1994 | Kittelsen . | |
| D. 356,188 | 3/1995 | Kittelsen . | |
| 2,750,941 | 6/1956 | Cathcart . | |
| 3,124,129 | 3/1964 | Grossberg . | |
| 3,207,153 | 9/1965 | Goldstein . | |
| 3,223,085 | 12/1965 | Gores et al. . | |
| 3,247,844 | 4/1966 | Berghash . | |
| 3,411,501 | 11/1968 | Greenberg . | |
| 3,485,242 | 12/1969 | Greenberg . | |
| 3,496,936 | 2/1970 | Gores . | |
| 3,768,465 | 10/1973 | Helmer . | |
| 3,855,053 | 12/1974 | Fuss | 156/244 |
| 3,943,924 | 3/1976 | Kallestad et al. . | |
| 4,044,763 | 8/1977 | Jacobs | 128/861 |
| 4,977,905 | 12/1990 | Kittelsen et al. . | |
| 5,152,301 | 10/1992 | Kittelsen et al. . | |
| 5,234,005 | 8/1993 | Kittelsen et al. | 128/861 |
| 5,339,832 | 8/1994 | Kittelsen | 128/861 |

OTHER PUBLICATIONS

Specification Sheet entitled "Celogen OT"; pp. 13, 14.

*Primary Examiner*—Michael A. Brown

*Attorney, Agent, or Firm*—Stephen Stanton; John Munday; Munday and Stanton

[57] ABSTRACT

A resilient composition including a thermoplastic material and gas pockets dispersed therein, where the pockets being formed by a blowing agent. A mouthpiece including a resilient thermoplastic material having a quantity of gas pockets dispersed therein. A method of making a mouthpiece achieved by first mixing a predetermined quantity of blowing agent with a resilient thermoplastic material. The mixture is then heated to a predetermined temperature forming gas pockets therein from the decomposition of the blowing agent. The mixture is then ejection molded in a mold to form the mouthpiece. A mouthpiece including a U-shaped base having a U-shaped cross-section. The base including a lower, horizontal floor with upwardly extending inner lingual and outer labial walls and having a posterior section proximate the user's molar teeth and an anterior section proximate the user's canine and incisor teeth. The mouthpiece further including a continuous ridge integral with the base and having an outer horizontal portion disposed on the exterior surface of the outer labial wall of the anterior section and terminating in opposite inner horizontal portions disposed on the interior surface of the horizontal floor of the posterior section. The mouthpiece may be formed from a resilient thermoplastic composition having a quantity of gas pockets dispersed therein.

14 Claims, 1 Drawing Sheet

MOUTHPIECE

FIELD OF THE INVENTION

The present invention relates to mouthpieces for insertion in a user's mouth for protection of the user's teeth, a composition having a quantity of gas pockets dispersed therein by heating a mixture of a thermoplastic compound and a blowing agent, and specifically to an improved mouthpiece formed from the composition to provide greater protection against shocks or blows to the user's teeth.

BACKGROUND OF THE INVENTION

Current mouthpieces, such as athletic mouthguards, are usually formed from thermoplastic materials and come in a variety of shapes, designs, thicknesses, and sizes. Each is designed to protect a user's teeth against physical shock or blows either directly to the teeth, or against a user's jaws, head, or even the user's body. Such mouthpieces are also designed to ensure the mouthpiece stays in position and prevent bite through of the mouthpiece by the user either during normal use or upon the application of shock or blows. Such mouthpieces also may absorb, attenuate, or deflect such blows to decrease the resultant transmitted force in an attempt to decrease or minimize injury to the user.

A myriad of designs exist which attempt to reduce such injury. Such protection has been afforded by custom fitting and/or by the inclusion of ribs, bosses, chambers, inserts, devices, or by simply increasing the thickness of the mouthpiece thereby increasing its bulk. This increased bulk may also increase tongue and breathing interference with resultant discomfort to the user. Some such mouthpieces are composite designs which increase production costs and may lead to higher failure rates.

U.S. Pat. No. 1,345,904 to Wishart describes a sponge rubber article and a method of making same. A method of vulcanizing a rubber based composition partially filling a perforated mold is described wherein gas is formed in the composition which results in the formation of cells. The gas in the cells adjacent the outer edges of the composition more readily escape through the perforations of the mold than the gas at the central portion. Thus, the cells are largest at the center of the sponge rubber composition and gradually decrease in size to the outer surface where the cells are extremely small rendering the outer surface relatively smooth.

However, the surface of such a sponge rubber composition still has an unacceptably rough surface allowing for bacterial growth and thus is undesirable for use in the mouth. Additionally, since the cells thus created are not uniform throughout the composition, uneven protection against blows in different thicknesses make the material unacceptable for complex structures such as mouthpieces, etc. The required partial filling of complex shape molds increases the difficulty of obtaining satisfactory complex finished structures. Even more importantly, the preferred formula and acceptable substitutes contain toxic compounds and therefore are unacceptable for use in the mouth or other like applications.

U.S. Pat. No. 3,532,091 to Lerman describes a mouthpiece that includes a relatively large closed passage-providing portion containing a fluid, either a liquid or a gas. The passage-providing portion is disposed either adjacent the labial surface of the teeth, between the occlusal surfaces of the upper and lower teeth, or in both positions. The closed fluid passage hydrostatically distributes force exerted at one point thereon over a much greater area, thereby decreasing the detrimental effect of the blow. The fluid filed passages may rupture upon the application of shock against the user's mouth causing the mouthpiece to fail, or they may develop a leak which may not be detected which would decrease its effectiveness unbeknownst to the user. Additionally, the use of liquids, which are incompressible, increases the amount of transmitted force. The use of relatively large fluid passages decrease the structural strength and integrity compared to a like sized device without such passages.

U.S. Pat. No. 4,672,959 to May et al describes a mouthpiece that includes a lens-like brace integrally formed in the outer upstanding portion of the elongated shell and positioned on the outer surface of the anterior teeth for reflecting any blow to the anterior teeth and reducing the shock to the teeth. The May mouthpiece further includes a thickened connecting portion overlying the biting surface of the posterior teeth to help prevent concussion and to lessen the shock to the tempro mandibular joint in the event of a blow to either the jaw or head. Indentations are formed in the thickened connecting portion opposite to the biting surfaces of the user's upper teeth having a size and shape complementary to and for receiving the user's lower teeth to form an occlusal index for positioning the user's lower teeth helping to eliminate the trauma of a blow to the side of the jaw.

U.S. Pat. No. 5,339,832 to Kittelsen et al describes a composite mouthguard having a tough, softenable thermoplastic mouthguard portion with a U-shaped base having upwardly extending inner lingual and outer labial walls. A shock absorbing and attenuating nonsoftening, resilient, low compression, elastomer framework is embedded in the mouthguard portion to absorb, attenuate and dissipate shock forces exerted on the mouthguard.

The Kittelsen et al framework includes posterior cushion pads within the posterior portions of a U-shaped base with enlarged portions in the bicuspid and molar regions of the teeth to fit on the bicuspid teeth adjacent the canine teeth and in the area of the first adult molars, respectively. The cushion pads and enlarged portions, inter alia, prohibit the user from biting too deeply into the soft thermoplastic ethylene vinyl acetate (EVA) of the mouthguard portion and assures there is no excessive upward displacement of the anterior portions of the lower mandible. A transition support portion extends forwardly from the posterior cushion pads and connects to an anterior impact brace. The anterior impact brace has rearwardly protruding anterior cushion pads extending through the upward outer labial wall and contact the anterior teeth of the upper jaw to attenuate and dissipate shock exerted thereto. The addition of an embedded nonsoftening, low compression, elastomer framework increases manufacturing costs and complexity. Also, after prolonged use and wear of the mouth protector the framework may become dislodged or exposed to the user's soft tissue. The internal framework may also fracture or break, which could remain undetected until injury results. Any blows directed and/or transmitted to the user's jaw are concentrated through the enlarged portions to the sets of molars and sets of bicuspids. Further protection would require thickening of the mouth protector increasing its bulk.

U.S. Pat. No. 2,630,117 to Coleman describes a multi piece mouth protector for athletes consisting of a soft rubber-like plastic shell and an integral rigid, arcuate palatal piece. The palatal piece imparts rigidity to the shell so that it locks to the upper jaw. The Coleman mouth protector includes a narrow metal band or wire embedded beneath the surface of the plastic shell to anchor the palatal piece to the shell. The plastic shell is preferably made from a transparent rubber-lie thermoplastic resin such as polyethylacrylate or other dental polyacrylate resins. The addition of a rigid palatal piece and the embedded metal band increase not only manufacturing costs and complexity, but also the risk of injury to the user after prolonged use and wear of the mouth protector wherein the rigid palatal piece and/or embedded metal band/wire may become dislodged or exposed to the user's soft tissue. Further protection would require thickening of the mouth protector increasing its bulk.

U.S. Pat. No. 2,643,652 to Cathcart describes a unitary mouth protector designed to improve free and easy mouth breathing and to assure against dislodgment under adverse conditions. The Cathcart mouth protector consists of a U-shaped trough with opposing parallel walls to overlie the inner and outer surfaces of the upper teeth of a user, and a palatal membrane overlying the palate of the user. Opposing, parallel shock absorbing ribs opposite the opposing walls partially overlie the upper portions of the inner and outer surfaces of the user's lower teeth to protect the lower teeth and prevent biting the cheeks or lips. Also, the floor of the Cathcart mouth protector trough gradually increases in thickness from the molars to the incisors to provide further protection to the teeth. The Cathcart mouth protector is formed from a soft flexible material such as soft vellum or pure Pará rubber, elastic resin, soft plastic or the like. Increased protection is provided by increasing the thickness of the trough increasing the discomfort of the user and decreasing a free airway for breathing and speech. Even further protection would require thickening of the mouth protector increasing its bulk and increasing the attendant problems.

Accordingly, it is an object of the present invention to provide a resilient composition having gas pockets therein to increase attenuation and dampening of shocks or blows applied thereto thus increasing protection against shocks or blows exerted thereto.

Another object of the present invention is to provide a unitary, customizable mouthpiece protecting the teeth and jaws and having a continuous integral ridge with an outer portion for further protection of the anterior teeth and an inner portion for further protection of the posterior teeth.

A further object of the present invention is to provide a unitary mouthpiece formed from a resilient composition having gas pockets therein to increase attenuation and dampening of shocks or blows applied thereto thus increasing protection against shocks or blows exerted thereto.

Yet another object of the present invention is to provide a one-piece tether for attaching a mouthpiece to a headgear and which will stretch and warn the user upon unwanted separation of the headgear from the user without forcibly extracting the mouthpiece from the user.

Other objects will appear hereinafter.

SUMMARY OF THE INVENTION

It has now been discovered that the above and other objects of the present invention may be accomplished in the following manner. Specifically, the present invention provides a resilient material having a quantity of gas pockets dispersed therein formed from heating a mixture of a resilient thermoplastic material and a blowing agent. In the preferred embodiment the thermoplastic material is ethylene vinyl acetate and the blowing agent is p, p'-oxybis (benzenesulfonyl hydrazide).

An injection molded mouthpiece is formed from the resilient material by mixing a predetermined quantity of blowing agent with a compatible thermoplastic material and then heating the mixture to a predetermined temperature range to form gas pockets in the resultant mixture. The heated mixture is then injection molded in a mouthpiece mold. The mouthpiece is cooled and removed from the mouthpiece mold. Upon initial use, the mouthpiece is reheated to soften the mouthpiece and to expand the gas pockets therein. The heated mouthpiece is immediately placed onto a user's teeth. The user applies suction between the jaw and mouthpiece to remove the excess moisture and air from between the mouthpiece and the teeth while gently biting down to form teeth indentations on both upper and lower surfaces therein. Once the mouthpiece cools, the teeth indentations remain, creating a custom fitting mouthpiece.

The mouthpiece has a U-shaped base with an essentially U-shaped cross-section formed by a lower, horizontal floor and upwardly extending inner lingual and outer labial walls. The base has an anterior section proximate the user's canine and incisor teeth and a posterior section proximate the user's molar and bicuspid teeth. A continuous ridge is integral with the base and has an anterior, outer horizontal section disposed on the exterior surface of the outer labial wall terminating in opposite posterior, inner horizontal sections disposed on the interior surface of the posterior base.

The anterior outer ridge section adds greater protection to the user's anterior teeth, the canine and incisor teeth, and the posterior inner ridge section affords greater protection to the user's posterior teeth, the molars and/or the bicuspids depending upon the size of the user's mouth relative to the mouthpiece. The ridge as a whole also gives structural strength and integrity to the mouthpiece especially when the mouthpiece is injection molded and when the mouthpiece is reheated for custom fitting to the user. Additionally, the ridge provides an unobstructed flow path for the heated thermoplastic material during injection molding to allow dispersion of the gas pockets to all parts of the mouthpiece, especially the thinner portions, for example the lingual and labial walls.

In the preferred embodiment, the mouthpiece further includes an anterior, horizontal tab projecting outwardly from the anterior ridge section to aid in reheating the mouthpiece for custom fitting, and in general for insertion and removal of the mouthpiece from the user's mouth. The tab is integral with the ridge and further increases the mouthpiece's structural strength and integrity, especially upon initial formation and during the custom fitting reheating process. A continuous looped flexible cord may be affixed through a hole in the tab for attachment of the mouthpiece to a user's headgear. If the headgear is forcibly removed from the user, the flexible cord will stretch and alert the user that an increasing amount of force being applied. This permits the user sufficient time to spit out or remove the mouthpiece, preventing inadvertent forceful removal of the mouthpiece with the resultant potential harm to the user.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 3:
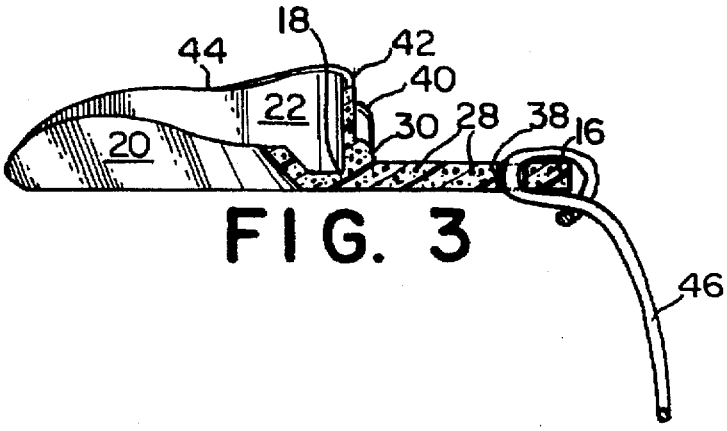
FIG. 3 is a sectional view taken along line 3, 3 of FIG. 1.
Figure 4:
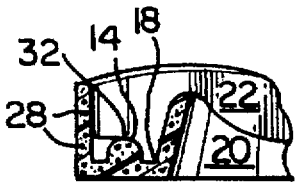
FIG. 4 is a sectional view taken along line 4, 4 of FIG. 1.

As shown in the drawings, a mouthpiece in accordance with the invention, generally shown as 10, includes base 12, continuous ridge 14, and tab 16. Mouthpiece 10 is formed from a resilient thermoplastic composition having a quantity of gas pockets 28 dispersed therein. As shown in FIGS. 3 and 4, gas pockets 28 are relatively small and are evenly dispersed throughout the entire structure. Gas pockets 28 are formed by the heating of a mixture of a blowing agent and a resilient thermoplastic material.

A predetermined quantity of blowing agent is mixed with a thermoplastic material and the resultant mixture is then heated to the thermoplastic material's processing temperature range. The thermoplastic material then liquefies and the blowing agent decomposes into, inter alia, gaseous components to form gas pockets dispersed in the resultant thermoplastic composition. The heated thermoplastic composition is then injection molded. The mouthpiece is cooled and removed from the mold.

Upon initial use, the mouthpiece is reheated to soften the mouthpiece and to expand the gas pockets therein. The heated mouthpiece is then immediately placed onto a user's upper teeth, the user applies suction between the upper jaw and mouthpiece to remove excess moisture and air from between the mouthpiece and the teeth while gently biting down to form teeth indentations on both upper and lower surfaces therein. Once the mouthpiece cools, the teeth indentations remain, creating a custom mouthpiece.

The gas pockets dispersed within the mouthpiece increase the protection against blows or shocks directed directly or indirectly to the mouthpiece for the same thickness of the mouthpiece. This novel composition of dispersed gas pockets may be used to form other mouthpiece designs to increase the protection afforded by those mouthpieces without thickening the mouthpieces. If a mouthpiece design is thickened to increase protection, the thicker design may interfere with speech and breathing, especially during periods of physical exertion. Thicker designs may also increase user discomfort and may aggravate the gag reflex.

In the preferred embodiment, raw material pellets of ethylene vinyl acetate (EVA) are mixed with 1% to 3.5% powdered Celagen OT™, a product low in toxicity and manufactured by Uniroyal Chemical. The chemical composition of Celagen OT is p, p'-oxybis (benzenesulfonyl hydrazide) and it decomposes in the processing range of EVA to produce, inter alia, a gas mixture consisting of about 91% nitrogen gas and 9% water vapor. A molding machine then heats the mixture to approximately 320 degrees Fahrenheit as the mixture is injected into the mouthpiece mold. As the mixture is heated, the gas formed from the decomposition of the Celagen OT forms, and is trapped within, gas pockets, or bubbles, in the resultant thermoplastic composition. The exterior surfaces of the resulting mouthpiece are very smooth and thus do not encourage bacterial entrapment and growth.

Various other combinations of known thermoplastic materials and blowing agents may be used such that the selected blowing agents decompose to produce gas in the processing temperature range of the thermoplastic material. When used to form mouthpieces or the like, the thermoplastic material, blowing agent and the resulting thermoplastic composition must be non-toxic and otherwise suitable for human use.

The thermoplastic composition is injection molded through one central tab cavity that forms tab 16. The mold includes an enlarged, continuous channel integral with the tab cavity and which forms ridge 14 and permits the gas pockets formed in the heated thermoplastic composition to flow throughout the entire mold to allow dispersion of the gas pockets in the resulting mouthpiece. Without this continuous channel in the mold, the gas pockets tend to accumulate at restricted points or thinner portions to limit the dispersion of gas pockets in the outer areas of the mouthpiece.

The mold is cooled for approximately 30 seconds, separated, and injector pins release the mouthpiece from the mold. The mouthpiece thermoplastic composition contains approximately 10% gas pockets. The gas pockets are small collectively and in thicker areas the gas pockets are slightly larger since there was more space for expansion during injection and render an otherwise translucent EVA finished piece opaque. After the mouthpiece is removed from the mold, the gas trapped in the gas pockets exert a pressure greater than atmospheric pressure and tend to slightly puff the surrounding thermoplastic composition and the mouthpiece as a whole. After a few days, the gas pocket pressure equalizes against the surrounding thermoplastic composition and the puffing subsides.

The mouthpiece is preferably designed for a user's upper teeth although it may be modified for use with a user's lower teeth. Upon initial use, the mouthpiece is custom fitted to a user's teeth as follows. Mouthpiece 10 is grasped by tab 16 and the remainder of the mouthpiece is immersed into water heated to at least approximately 160 degrees Fahrenheit for about 10 seconds to soften the mouthpiece. The gas in gas pockets 28 will heat and slightly re-expand to further puff mouthpiece 10 facilitating custom fitting. Mouthpiece 10 is removed from the hot water, shaken to remove the excess hot water, then immediately placed onto the user's teeth. The user applies suction between the upper jaw and mouthpiece 10 to remove the excess moisture and air from between the mouthpiece and the teeth while gently pressing the lower teeth into the bottom of the mouthpiece to further create upper and lower teeth indentations. The user may also further form the softened mouthpiece to his upper teeth by simultaneously packing mouthpiece 10 with his/her hands along the cheeks and lips proximate the selected jaw's teeth. Upon cooling, the mouthpiece retains the user's teeth indentations to provide a custom fitting mouthpiece.

Figure 2:
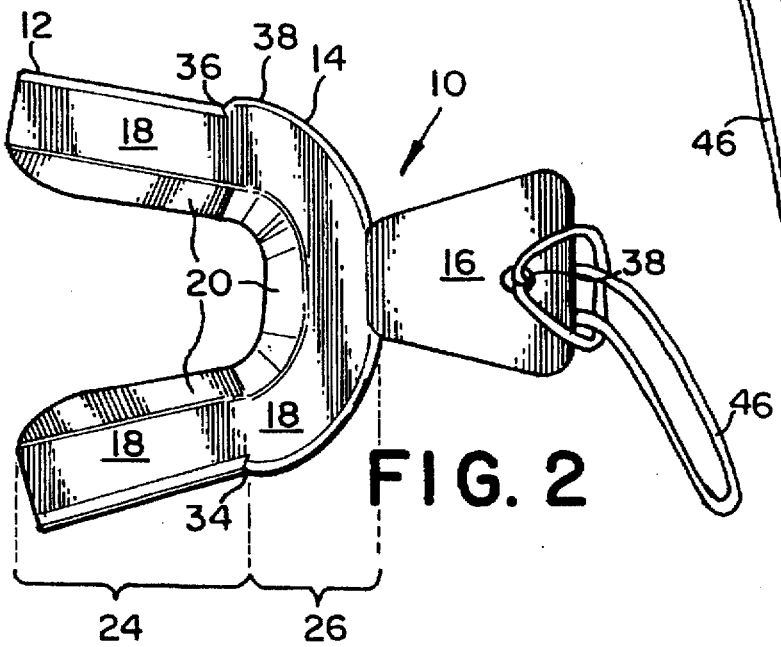
FIG. 2 is a bottom plan view of the improved mouthpiece of FIG. 1.

Base 12 is U-shaped, and has an essentially U-shaped cross-section formed by lower horizontal floor 18, and upwardly extending inner lingual wall 20 and outer labial wall 22 for receipt of a user's jaw and teeth. As best seen in FIG. 2, base 12 is divided into posterior sections 24 proximate the user's molar and/or bicuspid teeth, not shown, depending upon the size of the user's mouth relative to the mouthpiece 10, and anterior section 26 proximate the user's canine and incisor teeth, not shown. Ridge 14 is integral with, and continuous throughout the length of, base 12. Ridge 14 includes outer horizontal ridge section 30 disposed on the exterior surface of labial wall 22 of anterior base section 26, pierces labial wall 22 at 34, 36, and terminates in opposite, inner horizontal ridge sections 32 disposed on the upper interior surface of floor 18 of posterior base section 24.

Ridge 14, with integral tab 16, provide additional structural integrity and strength to mouthpiece 10 and provide sufficient rigidity to mouthpiece 10 to allow custom fitting to a user's teeth upon reheating. Ridge 14 also provides additional protection to the user's anterior teeth, the canines and incisors, and to the user's posterior teeth, the molars and/or bicuspids. Outer ridge section 30 overlies the user's anterior teeth and provide additional protection against blows or shocks directed against the front of the user's mouth by deflection, absorption and/or attenuation. The user's posterior teeth, the molars and/or bicuspids, overlie inner ridge sections 32 and as such are afforded additional protection against blows or shocks to the user's jaw or head and against any force transmitted therethrough. The user's molars and bicuspids have greater horizontal surface area than the user's anterior teeth allowing for greater dissipation of any shock or blow and any shock or force transmitted through inner ridge sections 32 is distributed among all the molars and/or bicuspids to further dissipate the force. The size of the user's mouth relative to mouthpiece 10 determines whether the user's bicuspids also overlie inner ridge sections 32.

Figure 1:
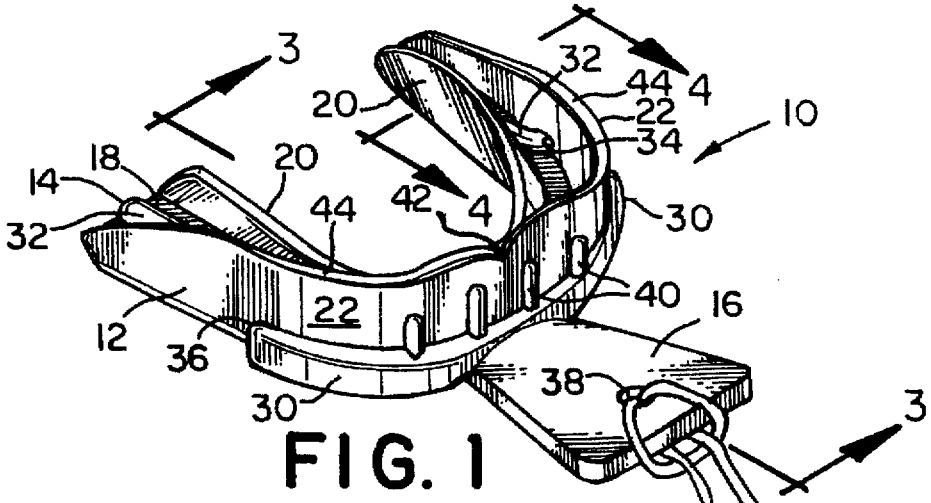
FIG. 1 is a perspective view of the improved mouthpiece.

As shown in FIGS. 1 and 3, ridge 14 may further include vertical, horizontally spaced ribs 40 extending from outer ridge section 30. Ribs 40 provide further protection to the user's anterior teeth against blows by deflection, absorption and/or attenuation. The most medial ribs 40 may extend to a greater height to account for the greater exposure of a user's front most teeth.

Outer labial wall 22 is substantially vertical throughout its length and for maximum comfort, its upper edge may have an arcuate, scalloped shape extending either side of medial notch 42 to accommodate the user's gums and upper jaw. Notches 44 may be formed in the upper free edge of labial wall 22 intermediate the length of the legs of mouthpiece 10 to accommodate muscle formations in the user's upper jaw. Inner lingual wall 20 slopes downwardly from a nearly vertical rise at either distal end proximate the user's rearmost molars, to a shortened, flattened rise proximate the user's incisor teeth to minimize contact with, and irritation of, the user's soft palate. This increases the comfort of the mouthpiece.

Tab 16 extends outwardly from the medial portion of outer ridge section 30. Tab 16 may be triangular in shape as shown, although other shapes are permissible. Tab 16 facilitates the insertion in, and removal of mouthpiece 10 from, a user's mouth and further facilitates the custom fitting of mouthpiece 10 to a user upon reheating by forming a rigid framework in conjunction with ridge 14. Tab 16 may include vertical hole 38 in its distal end for receipt of cord 46. Cord 46 is inserted through hole 38 and attached to tab 16 at one end, and is looped around and likewise attached to the user's headgear at its other end, not shown. Cord 46 is flexible, and may consist of a continuous loop to aid in quick and easy attachment. In the event the headgear is abruptly separated from the user such as when a football player is subjected to especially violent contact, cord 46 will stretch to alert the user that an increasing amount of force is being applied. This will allow sufficient time for the user to spit out or otherwise remove the mouthpiece 10 without having mouthpiece 10 being forcibly removed from the user's mouth resulting in potential harm to the user.

While particular embodiments of the present invention have been illustrated and described, it is not intended to limit the invention, except as defined by the following claims.

We claim:

1. A mouthpiece comprising a resilient thermoplastic material having a quantity of generally spherical shaped gas pockets dispersed therein.

2. The mouthpiece of claim 1, wherein said gas pockets in said resilient thermoplastic material are formed by a blowing agent.

3. The mouthpiece of claim 2, wherein said resilient thermoplastic material is ethylene vinyl acetate and said blowing agent is p, p'-oxybis (benzenesulfonyl hydrazide).

4. A method of making a mouthpiece having a quantity of gas pockets dispersed therein, comprising the steps of:

mixing a predetermined quantity of blowing agent with a resilient thermoplastic material to form a thermoplastic composition;

heating said thermoplastic composition to a predetermined temperature decomposing said blowing agent and forming gas pockets within said thermoplastic composition; then injecting said heated thermoplastic composition into a mouthpiece mold to form the mouthpiece.

5. The method of claim 4, further including the steps of:

cooling and removing the mouthpiece from said mouthpiece mold;

reheating the mouthpiece to a second predetermined temperature softening and expanding the mouthpiece by expanding said gas pockets; then immediately placing the heated mouthpiece onto a user's teeth and creating upper and lower teeth indentations in the mouthpiece in situ.

6. A mouthpiece for a user, comprising:

a U-shaped base composed of thermoplastic material having a U-shaped cross-section, said base including a lower, horizontal floor with upwardly extending inner lingual and outer labial walls, said base further having a posterior section proximate the user's molar and bicuspid teeth and an anterior section proximate the user's canine and incisor teeth; and a continuous ridge composed of the same thermoplastic material as said U-shaped base and integral with said base, said ridge having an outer horizontal portion disposed on the exterior surface of said outer labial wall of said anterior section and terminating in opposite inner horizontal portions disposed on the interior surface of said horizontal floor of said posterior section.

7. The mouthpiece of claim 6, wherein said inner ridge portions are sized to contact the user's molar teeth.

8. The mouthpiece of claim 6, further including an integral, anterior tab protruding medially from said outer horizontal ridge portion.

9. The mouthpiece of claim 8, wherein said tab includes a vertical opening, and further including an elastic cord means for attachment of the mouthpiece at said tab to a headgear.

10. The mouthpiece of claim 9, wherein said elastic cord means comprises a continuous looped elastic cord.

11. The mouthpiece of claim 6, wherein said outer ridge portion further includes at least two vertically extending, horizontally spaced parallel ridge members integral with, and protruding from, said anterior outer labial wall, said ridge members being dispersed equidistant about either side of the median of said outer horizontal ridge portion.

12. The mouthpiece of claim 6, wherein said base and said ridge are formed from a resilient thermoplastic material having a quantity of gas pockets dispersed therein.

13. The mouthpiece of claim 12, wherein said gas pockets in said resilient thermoplastic material are formed by a blowing agent.

14. The mouthpiece of claim 13, wherein said resilient thermoplastic material is ethylene vinyl acetate and said blowing agent is p, p'-oxybis (benzenesulfonyl hydrazide).

* * * * *